US005426272A

United States Patent [19]

Hendel

[11] Patent Number: 5,426,272

[45] Date of Patent: Jun. 20, 1995

[54] CONTACT ELEMENT FOR A PRINTED-CIRCUIT BOARD RELAY, AND A METHOD FOR ITS PRODUCTION

[75] Inventor: Horst Hendel, Berlin, Germany

[73] Assignee: Siemens Aktiengesellschaft, Munich, Germany

[21] Appl. No.: 107,680

[22] PCT Filed: Nov. 2, 1993

[86] PCT No.: PCT/DE92/00073

§ 371 Date: Aug. 17, 1993

§ 102(e) Date: Aug. 17, 1993

[87] PCT Pub. No.: WO92/15107

PCT Pub. Date: Sep. 3, 1992

[30] Foreign Application Priority Data

Feb. 20, 1991 [DE] Germany ..... 41 05 288.9

[51] Int. Cl.[6] ..... H01H 1/00

[52] U.S. Cl. ..... 200/275; 200/284; 29/874; 439/884

[58] Field of Search ..... 200/275, 271, 267, 284; 29/874, 882, 857; 439/884

[56] References Cited

U.S. PATENT DOCUMENTS

| | | | |
|---|---|---|---|
| 3,210,721 | 10/1965 | Dell | 439/884 X |
| 3,299,239 | 1/1967 | Mawney et al. | 200/275 |
| 3,624,571 | 11/1971 | Magida . | |
| 3,675,320 | 7/1972 | Watanabe | 29/874 |
| 3,945,709 | 3/1976 | Filson | 29/874 X |
| 4,082,928 | 4/1978 | Andresen | 200/275 X |
| 4,580,341 | 4/1986 | Chapelot | 29/874 |
| 4,599,589 | 7/1986 | Koehler | 200/275 X |
| 4,774,763 | 10/1988 | Palecek | 29/874 |
| 4,815,200 | 3/1989 | Ito | 29/874X |
| 5,134,249 | 7/1992 | Adachi | 29/872 X |

FOREIGN PATENT DOCUMENTS

| | | |
|---|---|---|
| 2389989 | 1/1978 | France . |
| 2395588 | 1/1979 | France . |
| 1141717 | 12/1962 | Germany . |
| 2102651 | 8/1972 | Germany . |
| 3721286 | 1/1989 | Germany . |
| 1342437 | 1/1974 | United Kingdom . |

*Primary Examiner*—Renee S. Luebke
*Attorney, Agent, or Firm*—Hill, Steadman & Simpson

[57] ABSTRACT

The contact element (10) is formed from a round wire, this round wire being bent in the shape of a hairpin having two parallel limbs (11, 12), at least one of which is used as a soldering connecting pin. The curved region between the two pins is stamped flat to form a common contact zone (14) having a flat surface, and is provided with a contact piece. In consequence, heavy-current contacts can be constructed particularly favorably with printed-circuit board connections.

8 Claims, 3 Drawing Sheets

CONTACT ELEMENT FOR A PRINTED-CIRCUIT BOARD RELAY, AND A METHOD FOR ITS PRODUCTION

BACKGROUND OF THE INVENTION

1. Field of the Invention

The invention relates to a contact element which may be anchored in a plastic base body for a relay, especially in a printed-circuit board relay, the contact element forming a connecting pin with at least one end section. In this case, the invention relates specifically to a contact element which is suitable for carrying large currents and is anchored in a base or a base plate, or even in a pocket in a coil former.

The invention furthermore relates to a method for producing such a contact element.

2. Description of the Related Art

Wire spring contacts are already known, for example from German Published Application 21 02 651. However, the wire springs disclosed therein are of relatively thin cross-section and in addition both the moving contact elements and the mating contact elements are constructed as long springs, as a result, there is a relatively high resistance between the contact point and the connecting pin, so that only small currents can be switched. This results from the fact that the springs are of round cross-sections which rest across one another in the contact region so that contact there between is only in the form of points, which in turn means a high contact resistance and excludes the switching of large currents.

This also applies essentially to wire spring contacts as are known from German Published Application 11 41 717. Reinforcement of the contact points is provided there in such a manner that the ends of the wires are bent at the contact point and thus rest on one another in a doubled manner. Nevertheless, the contacts there are in the form of points between thin wire cross-sections.

Short, round connecting pins are also known having glass bushings in bases of hermetically sealed relays as hown in German Published Application 16 15 838), but the round connecting pin there does not itself form the contact element. Instead, one additional contact spring element is welded onto the round connecting pin in the interior of the relay.

A relay is already known from U.S. Pat. No. 3,624,571 in which contact elements which are movably mounted in the base have a round cross-section and are stamped flat on their contact-making ends. However, the contacts disclosed therein are not sufficient for carrying large currents.

It is also normal in the case of reed contacts to provide the sections of the contact tongues which are fused into a small glass tube with a round cross-section, whilst the contact regions themselves are flattened. However, such reed contacts have ferromagnetic contact tongues have relatively poor electrical conductivity which, in addition, also are not formed into soldering pins for insertion into a printed-circuit board at their connecting sections. Such contact tongues would likewise not be suitable for use in a relay for switching high currents.

Similar contact tongues are also shown in French Published Application 2,389,989, in which the end of a spring tongue is in each case stamped and is provided with a contact piece. Once again only the cross-section of an elongated wire spring is available for passing current.

The problem in the case of the contact elements considered here is that simple small relays for switching high currents, as are used for example in motor vehicles, require mating contact elements having large cross-sections. As a rule, these mating contact elements are cut from a flat strip of material, and flat plugs having the same rectangular cross-section, or a rectangular cross-section of similar size, are integrally formed on the connecting of the flat strip side. If it is intended to place such relays on printed-circuit boards, then it is normal procedure to construct short soldering pegs on the ends of the flat plugs by cutting the strip of material, thereby forming soldering pegs can be inserted into soldering perforations in the printed-circuit board. Such soldering perforations in the printed-circuit boards are, however, virtually without exception drilled in order to ensure that they have relatively smooth walls and are free of stress cracks. A soldering peg which is formed by cutting a flat strip has, however, a square or rectangular cross-section which does not completely fill the round hole so that not only is a part of the possible cross-section lost for passing current, but the reliability of the connection on the printed-circuit board is also reduced.

SUMMARY OF THE INVENTION

The invention provides a contact element for a printed-circuit board relay, which is produced in a very simple manner, is matched by means of its connecting pins to the round printed-circuit board holes, and nevertheless makes possible large switching contact areas.

This object is achieved according by a contact element which is mounted in a plastic base body of a relay, the contact element having the following features:

- the contact element is integrally formed from a round wire as a rigid mating contact element,
- the contact element is bent in the shape of a hairpin having two parallel limbs, at least one of which is used as a connecting pin;
- the two limbs, which run parallel to one another and at a predetermined distance apart, are bent in the curved region to touch one another, and
- the curved region between the two limbs is stamped flat to form a common contact zone having a flat surface, and is covered with a contact layer. In contrast to conventional contact springs which are generally composed of round wire, a rigid mating contact element in which it is possible to select the wire cross-section and the wire material to correspond to the currents to be switched. In this case, a copper or a copper alloy are preferably considered as the material. By means of their round cross-section, the contact elements are not only well matched to the holes in the printed-circuit board but they can also be mounted well in corresponding holes or round perforations in the base body, by means of a push fit. This prevents, for example, rosin or other impurities from being able to rise along the connecting pins into the contact space during the soldering process. In contrast to sharp-edged contact supports, there is also no risk of rubbing and the insulating paths being adversely affected during insertion of the round contact elements. The pin ends can also be constructed to be free of burrs, by means of suitable stamping.

The contact element is in the shape of a hairpin and has two parallel limbs, at least one of which is used as a soldering connecting pin. The curved region between the two limbs is stamped flat to form a common contact zone having a flat surface so that a large contact zone is produced, which can be provided with contact layers or with a welding contact. The use of two limbs which are constructed as connecting pins also results in a doubled conductor cross-section for carrying high currents between the switching contact and the printed-circuit board. The two limbs are in this case arranged as connecting pins with a predetermined grid size, so that they can be inserted into two adjacent holes in the printed-circuit board and can be electrically connected to one another on the printed-circuit board or in another circuit part.

An advantageous method for producing a contact element according to the invention provides that the wire is initially bent in a U-shape to form two links spaced at a predetermined grid spacing, and that the curved region is then stamped flat by means of a stamping device. Before being stamped flat, the two limbs are bent in the region of the curve to touch one another. A contact piece is subsequently expediently welded or silver-soldered onto the contact zone.

Depressions or raised sections can be integrally formed on the contact element by means of a suitable design of the stamping device or of the stamping die. For example, studs for well-directed welding, or a guide groove, can be stamped in as an insertion aid. In this case, the contact element can also be shaped within predetermined dimensional limits either in terms of length and/or width by means of limits of the stamping holder. The stamping of the contact support into a flat shape also results in a space-saving arrangement in case an additional contact piece is to be fit in, since the contact piece does not project beyond the diameter of the connecting pin on the stamped-back contact zone. Overall height equalization on the contact surface of contacts of different height can be carried out during the processing by the extent to which the contacts are stamped flat. The leakage current behavior between two round contact elements is also improved in comparison with flat elements.

For a sufficiently tight fit in the base body, the connecting pins can be provided with retaining tabs which, for example, can be produced when the contact element is stamped or during the cutting of the connecting pins.

In a particularly preferred embodiment of the production method, the contact supports can be produced virtually without scrap. In this case, the wire is bent in a meandering shape to form a strip of contiguous contact elements which are opposite one another in an alternating manner. The individual contact elements are then obtained by separation along the center axis of this strip.

BRIEF DESCRIPTION OF THE DRAWINGS

The invention is explained in the following text using exemplary embodiments making reference to the drawings, in which.

DETAILED DESCRIPTION OF THE PREFERRED EMBODIMENTS

Figure 1:
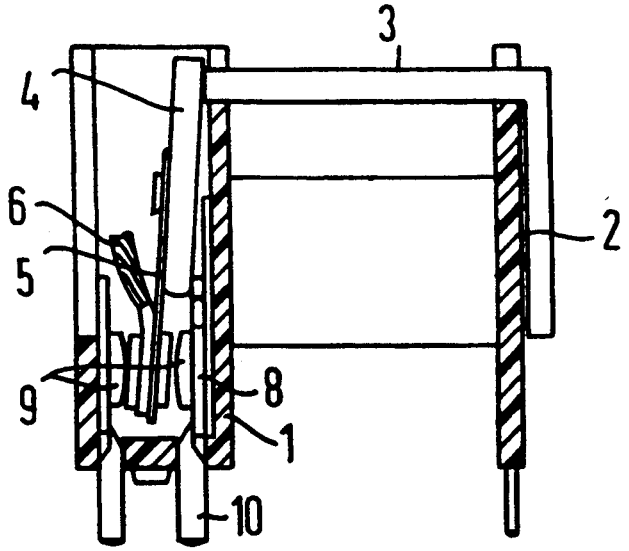
FIG. 1 shows a cross-section in elevation of a relay having a base body in which contact elements according to the invention are used.

Selected elements of a typical relay construction are shown in FIG. 1 including a coil former which is used as a base body 1 and is shown without a winding. The magnet system of the relay is shown schematically with a core 2, a yoke 3 and an armature 4. A contact spring 5 is operated by means of the armature 4 as a center-contact spring which has a braided-cable connection 6, which is shown only partially. Two mating contact elements 10, which are in each case stamped flat in their upper regions 8 and are provided with in each case one welded-on contact piece 9, are anchored in suitable perforations in the base body 1. The precise design and production of these contact elements 10 is explained in more detail on the basis of the following figures.

Figure 2A:
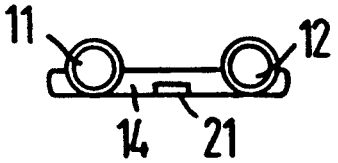
FIG. 2*a* shows an individual contact element having two limbs, in a bottom view.
Figure 2B:
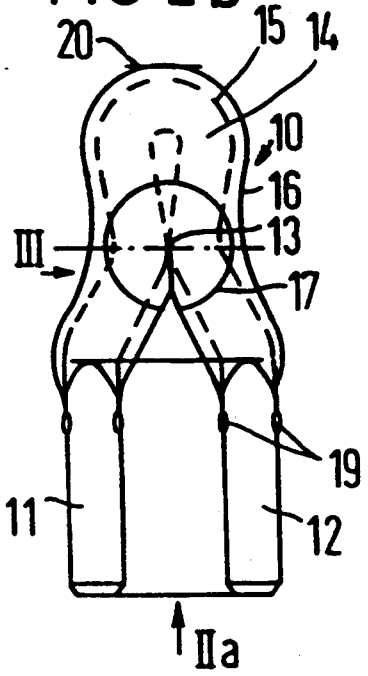
FIG. 2*b* shows the contact element of FIG. 2*a* in front view.
Figure 2C:
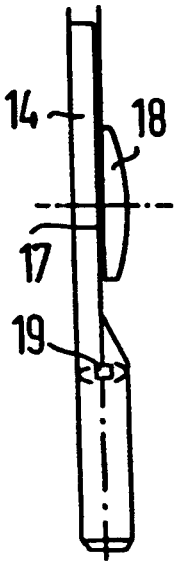
FIG. 2C shows the contact element of FIG. 2*a* in side view.

FIGS. 2*a*, 2*b* and 2*c* show a contact element 10 which is bent from a round wire into the shape of a hairpin. The contact element 10 is initially shaped with two limbs 11 and 12 lying parallel to one another the round cross-section of the wire being solder connecting pins spaced a predetermined distance apart, in accordance with a desired grid size. However, in the region of the curve, the two limbs 11 and 12 are pressed together to touch at a point 13, forming a type of eye. In addition, this curved region is stamped flat and thus forms a contact zone 14 having flat surfaces but a smaller thickness than the initial wire diameter. In FIG. 2*b*, the contours of the wire after bending and before being stamped flat are indicated by the dashed lines 15, while the continuous lines 16 reproduce the outlines of the completed contact element. A circular welding region 17 is stamped in a raised manner in the central region of the contact zone 14. As a consequence, a good welding surface is produced for a subsequently fitted contact piece 18, which is shown in the side view of FIG. 2*c* but not shown in the front view in FIG. 2*b*. In addition, retaining tabs 19 are stamped on the limbs 11 and 12, by means of which retaining tabs 19 the firm seating of the contact element in the perforations of the base body 1 is improved. A terminating surface 20 is stamped on the top of the contact zone 14 by suitable design of the stamping tool, as a result of which the contact element is limited to a predetermined length dimension overall. As can additionally be seen in FIG. 2*a*, a guide groove 21 can be stamped into the rear of the contact zone, as an insertion aid.

Figure 3:
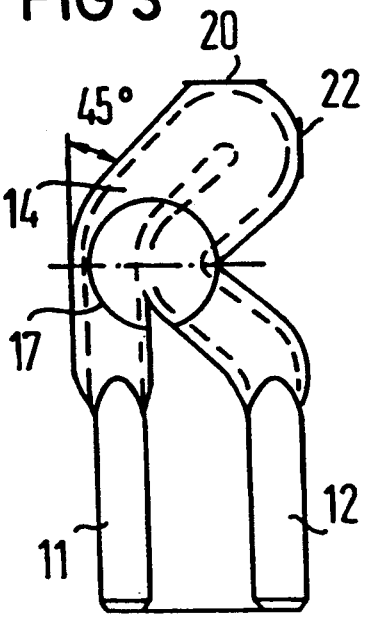
FIG. 3 shows a somewhat modified contact element, in a front view.

Depending on the requirements of the contact orientation, the curved region of the contact element, with the contact zone formed from it, can be designed either symmetrically with respect to the two limbs 11 and 12, as is shown in FIGS. 2*a*, 2*b* and 2*c* or can also be designed asymmetrically. FIG. 3 shows one possibility for the latter design, the contact region being constructed in an inclined manner at an angle of, for example, 45° with respect to the longitudinal axis of the limbs 11 and 12. In this case, not only a terminating surface 20 on the top but also a lateral terminating surface 22, on the right in the drawing, are formed during stamping, as a result of which the contact element assumes a predetermined fitting shape both in length and in width.

Figure 4A:
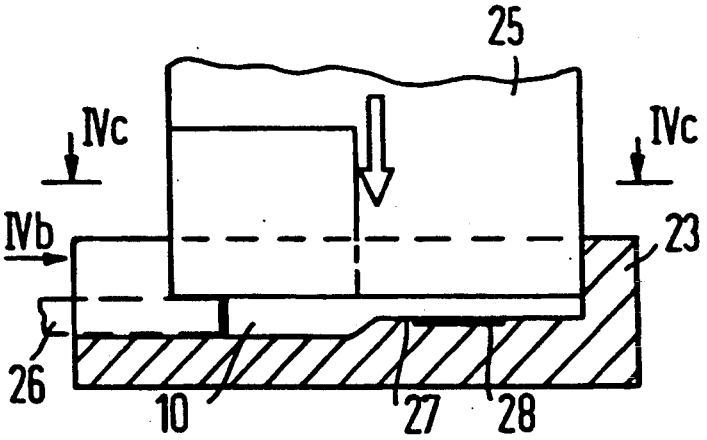
FIG. 4*a* shows a cross section of a stamping device for forming a contact element of the present invention.
Figure 4B:
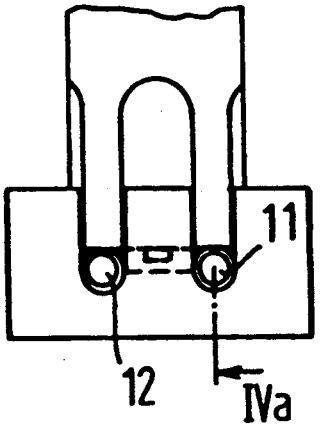
FIG. 4*b* shows an end view of the stamping device of FIG. 4*a*.
Figure 4C:
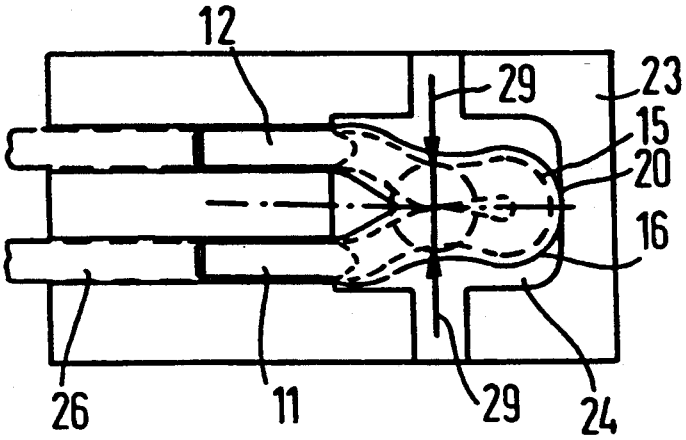
FIG. 4*c* shows a plan view of the stamping device of FIG. 4*a*.

FIGS. 4*a*, 4*b* and 4*c* shows the formation of the contact element in a stamping tool. This tool comprises a coining receptacle 23 having a stamping depression 24, which fixes the fitting shape and the boundaries of the contact element, and a stamping die 25, which is shown in FIGS. 4*a* and 4*b* but not shown in the plan view in FIG. 4*c*. The contact element 10 or a pre-bent wire 26 is inserted into the coining receptacle 23 and is then stamped into the corresponding shape using the stamping die 25, the contact zone 14, in particular, being stamped from the original contour 15 into the flattened contour 16. For this purpose, the coining receptacle 23 has a projection 27 in which, in turn, a depression 28 for constructing the welding region 17 is provided. However, before this, the curved region is stamped to make contact between the two limbs 11 and 12 by means of lateral stamping dies, which are introduced in the direction of arrows 29.

Figure 5:
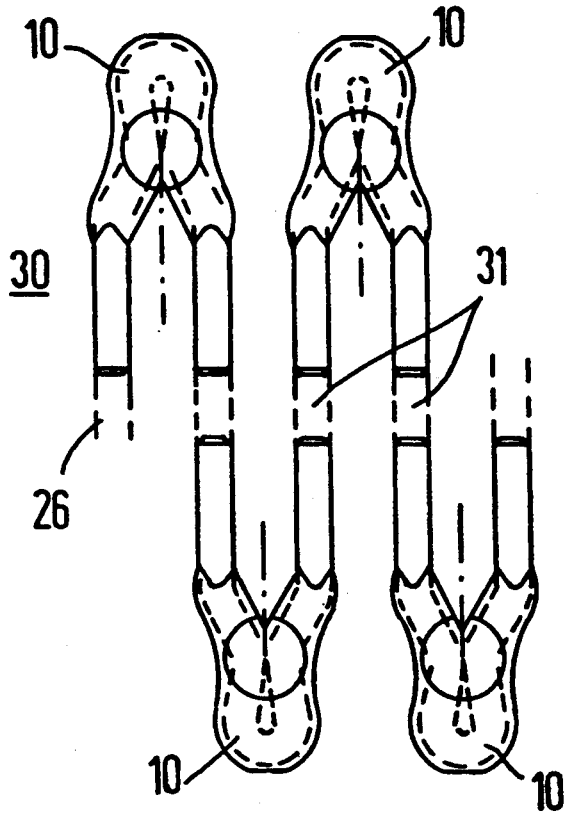
FIG. 5 shows a strip of contiguously constructed contact elements according to FIG. 2.

The production method is particularly advantageous if every contact element is not bent and stamped individually , but instead when a multiplicity of contact elements are formed from a continuous wire in a continuous production method. FIG. 5 shows a section of a continuous strip 30 of contact elements 10 which are constructed contiguously by bending the wire 26 in a meandering shape. The individual contact elements 10 are in this case be stamped to the desired shapes and provided with contact pieces successively, for example in a composite tool. The complete contact elements 10 are only then obtained by cutting away center pieces 31 or by cutting along the central axis of the strip 30.

Although other modifications and changes may be suggested by those skilled in the art, it is the intention of the inventors to embody within the patent warranted hereon all changes and modifications as reasonably and properly come within the scope of their contribution to the art.

I claim:

1. A contact element mountable in a plastic base body for relays, comprising:

a contact element integrally formed from a round wire and being a rigid mating contact element, said contact element being bent in a shape of a hairpin having two parallel limbs, at least one of said two parallel limbs being used as a connecting pin;

said two parallel limbs being a predetermined distance apart and being bent in a curved region to touch one another, and said curved region being stamped flat to form a common contact zone having a flat surface, and a contact layer covering at least a part of said contact zone.

2. A contact element as claimed in claim 1, said contact zone being positioned obliquely with respect to a longitudinal axis of said two parallel limbs.

3. A contact element as claimed in claim 1 , wherein said contact layer includes a contact piece.

4. A contact element as claimed in claim 1, further comprising: stamped-on retaining tabs on said two parallel limbs in regions intended for anchorage in a support.

5. A method for producing a contact element, comprising the steps of: bending a round wire initially in a U-shape with a predetermined grid spacing to form two limbs, bending the two limbs in a region of a curved region connecting the two limbs to touch one another and, finally, stamping flat the curved region by a stamping device.

6. A method as claimed in claim 5, further comprising the step of: stamping a raised welding region on a contact zone formed by the stamped flat curved region.

7. A method as claimed in claim 5, further comprising the steps of: forming a strip of contiguous contact elements which are opposite one another in an alternating manner by bending a wire into a meandering shape, and separating individual contact elements along a center axis of the strip.

8. A method for forming a contact element mountable in a plastic base body of a relay, comprising the following steps:

bending a substantially round wire into a shape of a hairpin having two parallel limbs which run parallel at a predetermined distance apart and a curved region;

bending said curved region of said two parallel limbs to touch one another;

stamping said curved region flat to form a common contact zone having a flat surface; and covering at least a portion of said flat surface with a contact layer.

* * * * *